US008777219B2

(12) United States Patent
Deno

(10) Patent No.: US 8,777,219 B2
(45) Date of Patent: Jul. 15, 2014

(54) SHEET CONVEYANCE APPARATUS AND IMAGE FORMING APPARATUS

(75) Inventor: Kouhei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/536,541

(22) Filed: Jun. 28, 2012

(65) Prior Publication Data

US 2013/0009358 A1 Jan. 10, 2013

(30) Foreign Application Priority Data

Jul. 4, 2011 (JP) ..... 2011-148216

(51) Int. Cl.
*B65H 7/10* (2006.01)

(52) U.S. Cl.
USPC ..... 271/228; 271/242

(58) Field of Classification Search
USPC ..... 271/227, 228, 242, 252
See application file for complete search history.

(56) References Cited

U.S. PATENT DOCUMENTS 4,685,664 A * 8/1987 Petersdorf ..... 271/227
4,805,892 A * 2/1989 Calhoun ..... 271/225
5,219,159 A * 6/1993 Malachowski et al. ..... 271/228
5,273,274 A * 12/1993 Thomson et al. ..... 271/228
5,322,273 A * 6/1994 Rapkin et al. ..... 271/227
6,135,446 A * 10/2000 Thiemann et al. ..... 271/228
6,647,884 B1 * 11/2003 La Vos et al. ..... 101/485
7,677,558 B2 * 3/2010 Kinoshita et al. ..... 271/227
2008/0024808 A1 * 1/2008 Masuda ..... 358/1.12
2012/0286468 A1 * 11/2012 Ui ..... 271/228

FOREIGN PATENT DOCUMENTS

JP 2893540 B2 5/1999
JP 3191834 B2 7/2001
JP 4016621 B2 12/2007

* cited by examiner

*Primary Examiner* — Ernesto Suarez
(74) *Attorney, Agent, or Firm* — Canon U.S.A., Inc. IP Division

(57) ABSTRACT

A sheet conveyance apparatus includes a control unit which controls the operation of a registration roller shift motor so as to perform positional deviation correction based on the detection result of a contact image sensor (CIS) configured to detect positional deviation in the width direction of a sheet. When the amount by which the registration roller shift motor moves the registration roller in the width direction exceeds an upper limit value, the control unit limits the movement amount by which the registration roller shift motor moves the registration roller in the width direction.

13 Claims, 15 Drawing Sheets

FIG. 12

| | | INPUT SKEW (mm) | | | | | | | | | | | | |
|---|---|---|---|---|---|---|---|---|---|---|---|---|---|---|
| | | −6 | −5 | −4 | −3 | −2 | −1 | 0 | 1 | 2 | 3 | 4 | 5 | 6 |
| INPUT POSTIONAL DEVIATION AMOUNT (mm) | −4 | × | × | × | × | × | × | × | × | × | ○ | ○ | ○ | ○ |
| | | × | × | × | × | × | × | × | × | × | ○ | ○ | ○ | ○ |
| | −3 | × | × | × | × | ○ | ○ | ○ | ○ | ○ | ○ | ○ | ○ | ○ |
| | | × | × | ○ | ○ | ○ | ○ | ○ | ○ | ○ | ○ | ○ | ○ | ○ |
| | −2 | ○ | ○ | ○ | ○ | ○ | ○ | ○ | ○ | ○ | ○ | ○ | ○ | ○ |
| | | ○ | ○ | ○ | ○ | ○ | ○ | ○ | ○ | ○ | ○ | ○ | ○ | ○ |
| | −1 | ○ | ○ | ○ | ○ | ○ | ○ | ○ | ○ | ○ | ○ | ○ | ○ | ○ |
| | | ○ | ○ | ○ | ○ | ○ | ○ | ○ | ○ | ○ | ○ | ○ | ○ | ○ |
| | 0 | ○ | ○ | ○ | ○ | ○ | ○ | ○ | ○ | ○ | ○ | ○ | ○ | ○ |
| | | ○ | ○ | ○ | ○ | ○ | ○ | ○ | ○ | ○ | ○ | ○ | ○ | ○ |
| | 1 | ○ | ○ | ○ | ○ | ○ | ○ | ○ | ○ | ○ | ○ | ○ | ○ | ○ |
| | | ○ | ○ | ○ | ○ | ○ | ○ | ○ | ○ | ○ | ○ | ○ | ○ | ○ |
| | 2 | ○ | ○ | ○ | ○ | ○ | ○ | ○ | ○ | ○ | ○ | ○ | ○ | ○ |
| | | ○ | ○ | ○ | ○ | ○ | ○ | ○ | ○ | ○ | ○ | ○ | × | × |
| | 3 | ○ | ○ | ○ | ○ | ○ | ○ | ○ | ○ | ○ | × | × | × | × |
| | | ○ | ○ | ○ | ○ | × | × | × | × | × | × | × | × | × |
| | 4 | ○ | ○ | ○ | ○ | × | × | × | × | × | × | × | × | × |

SHEET CONVEYANCE APPARATUS AND IMAGE FORMING APPARATUS

BACKGROUND OF THE INVENTION

1. Field of the Invention

The present invention relates to a sheet conveyance apparatus configured to convey a sheet while pinching the same, and to an image forming apparatus, such as a copying machine, a facsimile apparatus, or a printer, equipped with the sheet conveyance apparatus.

2. Description of the Related Art

In an image forming apparatus such as a copying machine, a facsimile apparatus, or a printer, it can happen that the printing position of a printed image is deviated with respect to the sheet. This is mainly due to the fact that within the feeding cassette, for example, the sheet is deviated with respect to the image in the width direction, which is orthogonal to the conveyance direction, or that the sheet is arranged obliquely. Further, also in the conveyance path to be passed after the feeding, positional deviation in the sheet width direction or skew feed may be generated. In view of this, as configurations for achieving an improvement in terms of image printing accuracy, a skew feed correction through abutment of a sheet leading edge portion and a positional deviation correction through movement in the width direction of a registration roller, have been discussed.

Japanese Patent No. 4016621 discusses a registration configuration equipped with a skew feed correction mechanism through abutment of the sheet leading edge portion, in which the sheet leading edge portion is caused to abut on the registration roller to thereby effect skew feed correction. Specifically, the advancement side in the width direction of the sheet leading edge portion conveyed from a roller (hereinafter referred to as the upstream roller) provided on the upstream side of the registration roller first abuts on a nip edge line of the registration roller at rest. And, further, through excessive pushing by the upstream roller, a sheet loop is formed between the upstream roller and the registration roller. As a result, the sheet is turned within the loop, whereby transition of the abutment in the width direction of the sheet leading edge portion to the delay side is gradually effected. Eventually, the entire region in the width direction of the sheet leading edge portion abuts on the nip edge line and conforms thereto, thereby effecting skew feed correction. After this, the registration roller is driven to thereby convey the sheet to the image forming unit.

Japanese Patent No. 2893540 discusses a configuration for correcting positional deviation through registration roller shift, which is equipped with a positional deviation detection sensor configured to detect aside end portion in the width direction of the sheet, and a mechanism configured to move the registration roller in a thrust direction (the sheet width direction). And, in the state in which the sheet is pinched by the registration roller, thrust movement is effected until the side end portion in the sheet width direction is detected by the positional deviation detection sensor, whereby positional deviation in the width direction of the sheet is corrected.

However, in such a positional deviation correction device utilizing registration roller shift, the sheet is moved in the width direction while pinched between the upstream roller and the registration roller. Thus, twist is generated in the sheet loop between the two rollers. Due to a reaction force attributable to this loop twist, the sheet may undergo skew feed at the registration roller, or wrinkles or the like may be generated. In particular, in the case of a thick sheet of high stiffness, the loop twist reaction force is large, so that the aggravation of the skew feed is conspicuous.

In view of this, Japanese Patent No. 3191834 discusses a configuration for eliminating the loop twist described above. In this configuration, the upstream roller is supported by a linear bearing member so as to be capable of moving in the thrust direction. Due to this configuration, when the registration roller moves in the thrust direction while pinching the sheet, the upstream roller is also thrust-moved through the sheet, whereby it is possible to eliminate the loop twist. Compression springs are arranged at both end portions of the upstream roller and urge the upstream roller toward the center in the width direction, so that, after the trailing edge portion of the sheet has left the upstream roller, the upstream roller is automatically restored to the former position (the central position in the width direction).

However, the above-described conventional configuration involves the following problem.

The loop twist between the registration roller and the upstream roller is generated not only by the above-mentioned positional deviation correction through the movement in the thrust direction of the registration roller, but also by the skew feed correction through the abutment of the sheet leading edge portion. Specifically, when the sheet undergoing skew feed abuts on the registration roller, the loop is larger at the leading side edge than at the trailing side edge, so that loop twist occurs. As a result, due to a loop twist reaction force, sheet skew feed, wrinkles, etc. may be generated at the registration roller.

It is true that the configuration as discussed in Japanese Patent No. 3191834 is effective as a method for eliminating loop twist. However, the linear bearing member for supporting the upstream roller is rather expensive. Further, the configuration is rather complicated, and the reaction force due to the compression spring urging the upstream roller toward the center in the width direction causes a reduction of the loop twist mitigating effect.

Further, copying machines in recent years have been being more and more reduced in size. Thus, the sheet is nipped not only by the upstream roller but also by a plurality of rollers as the rollers upstream side of the registration roller. Further, in some cases, the sheet trailing edge reaches even the feeding unit. In view of this, it is not realistic to arrange the above-described linear bearing member on every one of the rollers on the upstream side of the registration roller. On the other hand, a sufficient effect cannot be expected when the linear bearing member is only arranged on the upstream roller.

After all, in the configuration in which the skew feed correction through the abutment of the sheet leading edge portion and the positional deviation correction through the movement in the thrust direction of the registration roller are performed at the same time, it is necessary to take into account the superposition of the loop twists due to both corrections. Depending upon the combination of the amounts and directions of these two kinds of loops, the sheet loop twist may be promoted or canceled out. To attain a high-quality image, it is necessary to mitigate the aggravation of the skew feed due to the sheet loop twist.

SUMMARY OF THE INVENTION

The present invention is directed to mitigating the aggravation of the skew feed when correcting the positional deviation attributable to the sheet loop twist reaction force while achieving a reduction in apparatus size and cost.

According to an aspect of the present invention, a sheet conveyance apparatus includes a first conveyance unit configured to convey a sheet while pinching the same, a second conveyance unit configured to be abutted on by a leading edge portion of the sheet conveyed by the first conveyance unit and convey the sheet that has undergone skew correction through the abutment while pinching the same, a position detection unit configured to detect positional deviation amount from a reference position of an end portion in a width direction which is orthogonal to the sheet conveyance direction, a correction unit configured to move the second conveyance unit pinching the sheet in the width direction to correct positional deviation in the width direction of the sheet; and a control unit configured to control the operation of the correction unit so as to correct the positional deviation based on the detection result of the position detection unit, wherein the control unit is configured, when the positional deviation amount detected by the position detection unit exceeds an upper limit value, to limit the moving amount of the second conveyance unit in the width direction moved by the correction unit.

According to the present invention, when the positional deviation amount detected by the position detection unit exceeds an upper limit value, the control unit limits the amount by which the correction unit moves the second conveyance unit in the width direction. This helps to mitigate the aggravation of the skew at the time of positional deviation correction while achieving a reduction in apparatus size and cost.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 12 is a table illustrating an upper limit value of the width-direction positional deviation correction amount when input skew is taken into account.

DESCRIPTION OF THE EMBODIMENTS

Various exemplary embodiments, features, and aspects of the invention will be described in detail below with reference to the drawings.

In the following, exemplary embodiments of the present invention will be illustrated in detail. However, the dimensions, materials, configurations of the components of the exemplary embodiments illustrated below and the relative layout thereof are to be changed as appropriate according to a construction and various condition of the apparatus to which the present invention is applied. Thus, unless otherwise specified, the scope of the present invention is not to be restricted thereto.

An image forming apparatus equipped with a sheet conveyance apparatus according to the first exemplary embodiment will be illustrated. Here, a sheet skew correction apparatus will be illustrated by way of example as the sheet conveyance apparatus, and a color digital printer will be illustrated by way of example as the image forming apparatus equipped with the sheet skew correction apparatus.

Figure 14:
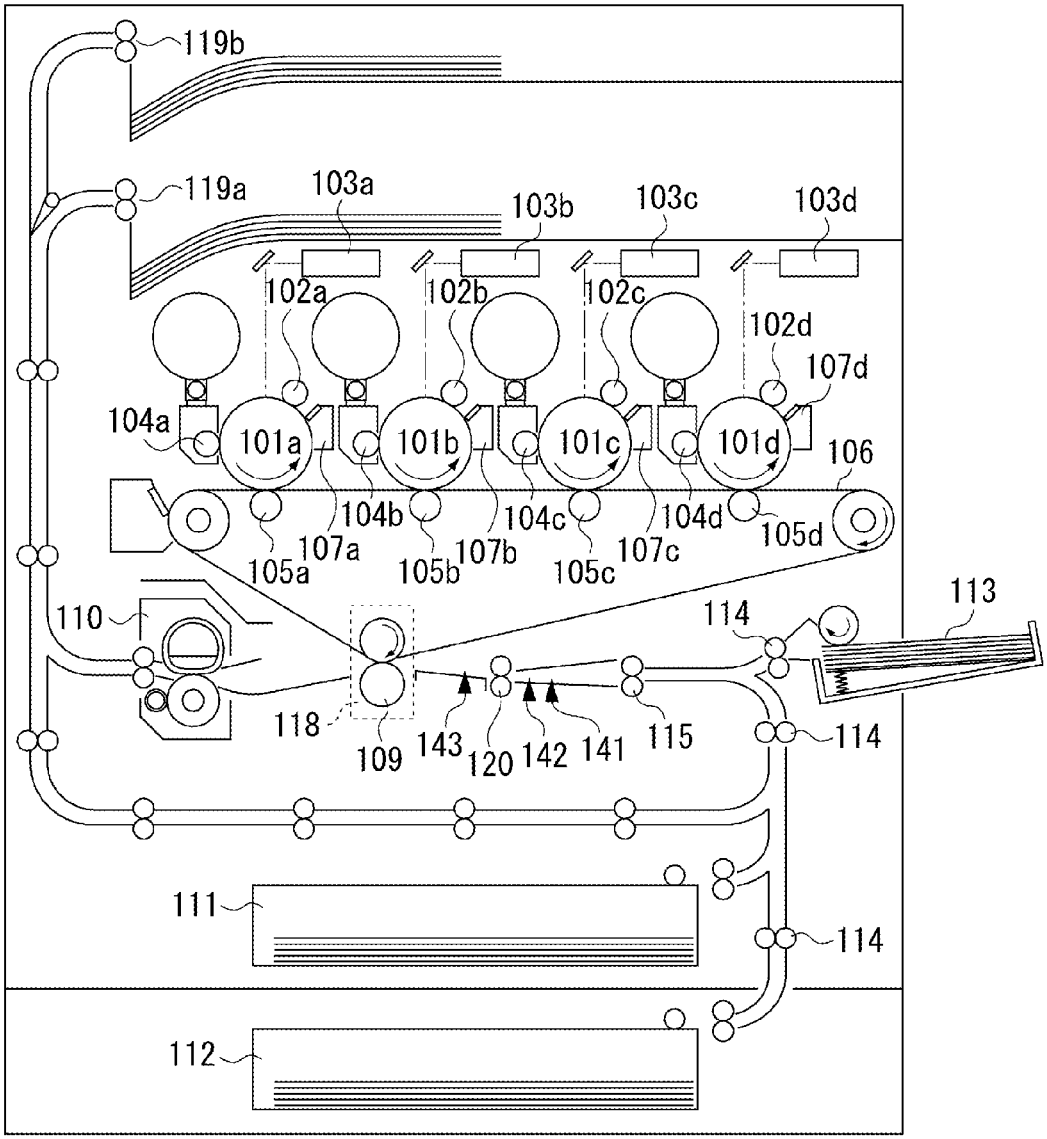
FIG. 14 is a schematic sectional view illustrating an entire image forming apparatus which is equipped with a sheet skew correction apparatus.

FIG. 14 is a schematic sectional view of the color digital printer. In the printer illustrated in FIG. 14, the surfaces of four photosensitive drums 101*a* through 101*d* are uniformly charged with an electric charge by charging rollers 102*a* through 102*d*, respectively. Image signals of yellow (Y), magenta (M), cyan (C), and black (K) are respectively input to laser scanners 103*a* through 103*d*, and the drum surfaces are irradiated with laser beams according to the image signals, whereby the electric charge is neutralized, and latent images are formed. The latent images formed on the photosensitive drums are developed with yellow, magenta, cyan, and black toners, respectively, by developing devices 104*a* through 104*d*. The toner images developed on the photosensitive drums are successively transferred to an intermediate transfer belt 106 serving as an image bearing member in the form of an endless belt by primary transfer rollers 105*a* through 105*d*, and a full-color toner image is formed on the intermediate transfer belt 106. After the transfer, cleaning is performed on the surfaces of the four photosensitive drums 101*a* through 101*d* by cleaning devices 107*a* through 107*d*, respectively. The photosensitive drums and the respective processing units acting thereon (the charging rollers, the developing devices, and the cleaning units) constitute an image forming unit for forming an image on a sheet.

On the other hand, a sheet, which is a material to be transferred consisting of a recording paper or the like fed from a feeding cassette 111 or 112 or a manual feeding unit 113, is conveyed toward a registration roller 120 by a conveyance roller 114 and an upstream roller 115. The sheet is conveyed in conjunction with the toner image on the intermediate transfer belt 106 by the registration roller 120, whereby control is effected such that no misregistration occurs between the sheet and the image. The toner image on the intermediate transfer belt 106 is transferred by a secondary transfer roller 109 included in an image transfer unit 118. After the transfer, cleaning is performed on the surface of the intermediate transfer belt 106 by a belt cleaning device 108. The sheet to which the toner image has been transferred is conveyed to a fixing device 110, where heating and pressurization are effected to thereby fix the toner image to the sheet. After this, the sheet is discharged to the exterior of the apparatus main body via a discharge unit 119*a* or 119*b*.

Each feeding cassette has a side regulation plate configured to regulate the position of the sheet in the width direction which is orthogonal to the sheet conveyance direction. The side regulation plate is movable in conformity with a side end portion in the width direction of the sheet. result, it is possible to adjust the position of the sheet in the width direction (the position thereof in a direction intersecting with the sheet conveyance direction) to the position of the image transferred at the image transfer unit. The side regulation plate also serves to prevent skew apt to be generated at the time of feeding and by the conveyance roller on the downstream side of the feeding roller. Actually, however, due to slight play between the side regulation plate and the sheet, deviation of the position of the end portion in the width direction of the sheet and sheet skew are generated, and the positional deviation amount in the width direction of the sheet and the sheet skew amount may be varied when the sheet is input to the registration roller.

In view of this, at first, the skew is corrected by causing the sheet leading edge portion to abut on the registration roller 120 at rest. At this time, the sheet is conveyed by the upstream side roller 115, which is the first conveyance unit on the upstream side in the conveyance direction of the registration roller 120, which is the second conveyance unit, and a loop is formed between the two rollers. The sheet loop amount at this time is adjusted by performing excessive feeding by a predetermined amount after the sheet has passed a registration sensor 142 configured to detect the sheet leading edge portion. The registration sensor 142 is a skew detection unit configured to detect skew of the sheet before the leading edge portion of the sheet is caused to abut on the registration roller 120.

Further, a contact image sensor (CIS) (position detection unit) 143 for detecting the position of the end portion in the width direction orthogonal to the sheet conveyance direction is arranged between the registration roller 120 and the secondary transfer roller 109. The CIS 143 is a position detection unit configured to detect positional deviation from a reference position (a predetermined sheet end position in the width direction) of the end portion in the width direction orthogonal to the sheet conveyance direction. A correction unit illustrated below moves the registration roller 120 pinching the sheet in the width direction (thrust direction), whereby the positional deviation in the width direction of the sheet is corrected. Further, as will be illustrated in detail below, an upper limit value is set to the amount by which the correction unit moves the registration roller 120 in the width direction. When the movement amount exceeds the upper limit value, the movement of the registration roller 120 by the correction unit is limited.

Figure 1:
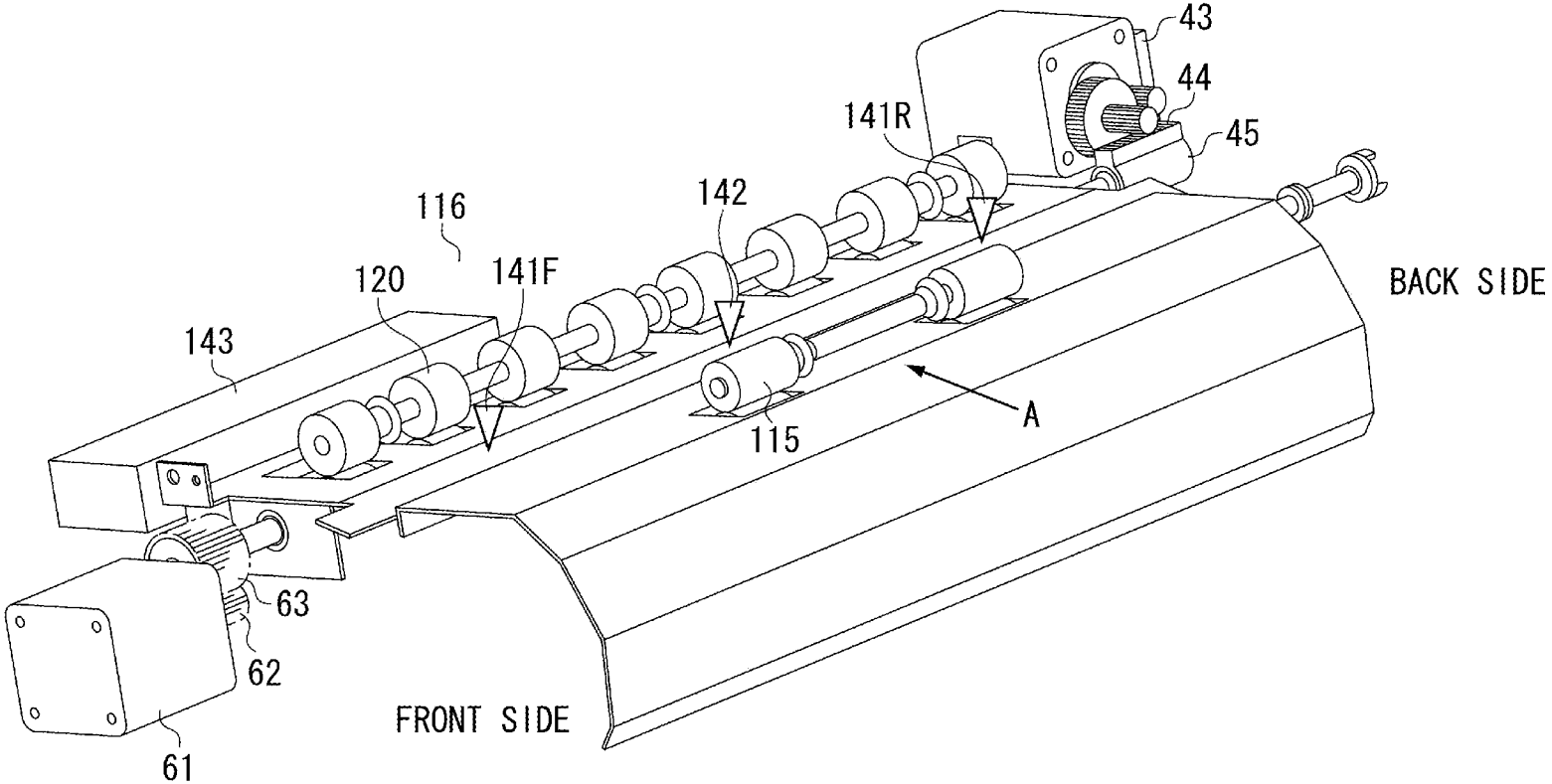
FIG. 1 is a perspective view of a registration unit according to a first exemplary embodiment.

The construction of the registration unit, skew correction operation, and width-direction positional deviation correction operation will be illustrated. FIG. 1 is a perspective view of a sheet skew correction apparatus equipped with a registration unit 116 according to the present exemplary embodiment. In FIG. 1, only the lower side of the sheet conveyance guide is illustrated, and the upper side thereof is omitted.

As illustrated in FIG. 1, in the upstream roller 115, a before-registration lower roller formed of a rubber roller, and a before-registration upper roller having a runner formed of polyacetal resin (POM), are arranged opposite each other. A spring is engaged with each of a plurality of bearing portions provided on the before-registration upper roller, and the registration upper roller is pressurized against the before-registration lower roller, forming a nip. The conveyance of the sheet is effected by using a before-registration drive motor (not illustrated) as a drive source.

Similarly, in the registration roller 120, a registration lower roller formed of a rubber roller and a registration upper roller having a runner formed of POM are arranged opposite each other. A spring is engaged with each of a plurality of bearing portions provided on the registration upper roller, and the registration upper roller is pressurized against the registration lower roller, forming a nip. As stated above, the registration roller 120 serves as an abutment reference for sheet skew correction and as a unit for correcting positional deviation of the sheet in the width direction. Since it is necessary to accurately perform the sheet conveyance to the image transfer unit, the pinching pressure of the registration roller 120 is set in many cases higher than that of the other rollers. It ranges approximately from 2.5 kgf to 5 kgf. The conveyance of the sheet is performed by using a registration roller drive motor 61 as the drive source.

The mechanism of the correction unit, which shifts the sheet in the width direction through movement of the registration roller 120 in the width direction, is as follows. By a drive force from a registration roller shift motor 43 constituting the correction unit, a pinion gear 44 is rotated, and a rack 45 is translated. The rack 45 is supported with respect to the registration roller rotation shaft so as to be rotatable in the rotating direction and stationary in the thrust direction. This allows the registration roller 120 to make a movement in the thrust direction (the axial direction), enabling to shift the sheet pinched by the registration roller in the thrust direction. As compared with a registration roller motor gear 62, a registration roller input gear 63 has a larger tooth width in the thrust direction. This is for the purpose of maintaining the mesh engagement of the gears and of enabling the rotation of the registration roller 120 even when the registration roller 120 and the registration roller input gear 63 move in the thrust direction.

As stated above, the position of the end portion in the width direction of the sheet is detected by the CIS 143. In the sheet conveyance direction, the CIS 143 is arranged on the upstream side of the image transfer unit, and, in the width direction orthogonal to the sheet conveyance direction, the CIS 143 is arranged so as to be nearer to one side in the width direction from the center. This is because detection of the side end portion of one side of the sheet ranging from the minimum to maximum width suffices.

On the other hand, skew of the sheet is detected by a plurality of optical sensors. Generally speaking, in the system in which the sheet leading edge portion is caused to abut on the registration roller, there is no need to detect the skew amount. However, as illustrated below, the present exemplary embodiment is characterized by the fact that the upper limit value of the amount of movement in the width direction of the registration roller 120 by the correction unit is set through a combination of the positional deviation amount in the width direction of the sheet before the sheet reaches the registration roller and the skew amount. In this case, as illustrated in FIG. 1, optical sensors (skew detection units) 141F and 141R are respectively arranged at one side (the apparatus front side) and at the other side (the apparatus back side) in the sheet width direction. When the sheet leading edge portion enters in the skew state, a time difference Δt between the timing of passing the optical sensors 141F and 141R is generated. Assuming that the sheet conveyance speed V is a nominal value, the skew amount is calculated as follows: $s=V\times\Delta t$. The calculation of the skew amount is performed by a control unit illustrated below based on the signals from the optical sensors 141F and 141R.

Next, the basic skew correction operation and width-direction position correction operation for the sheet at the registration unit 116 will be illustrated with reference to FIGS. 2A through 2D, FIGS. 3A through 3D, and FIG. 5.

Figure 2A:
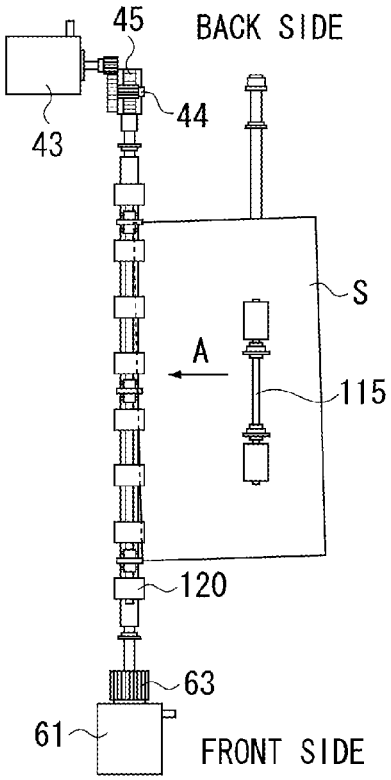
FIGS. 2A, 2B, 2C, and 2D are front views illustrating skew correction and positional deviation correction operations of the registration unit according to the first exemplary embodiment.
Figure 2B:
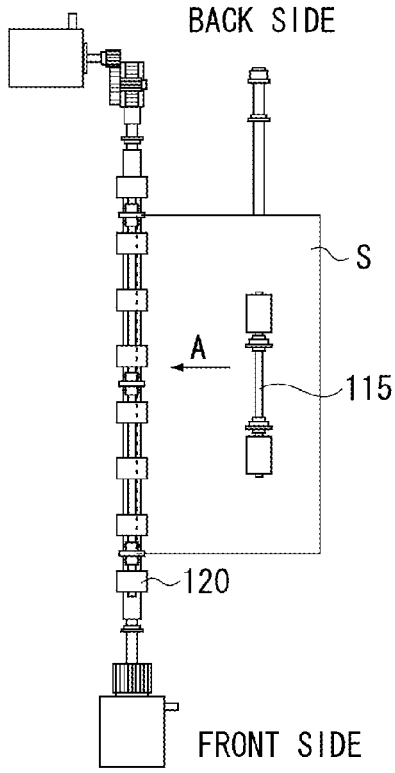
Figure 2C:
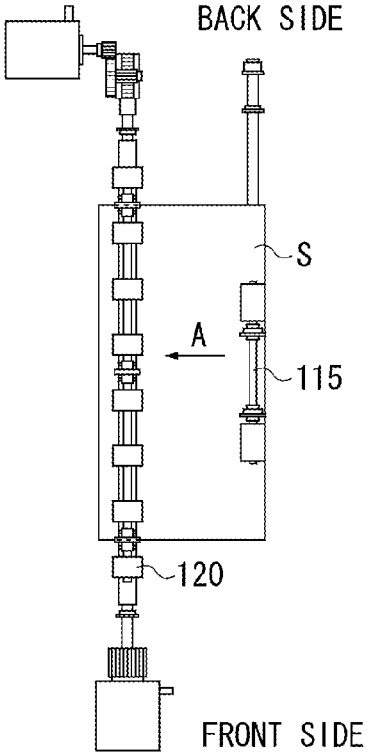
Figure 3A:
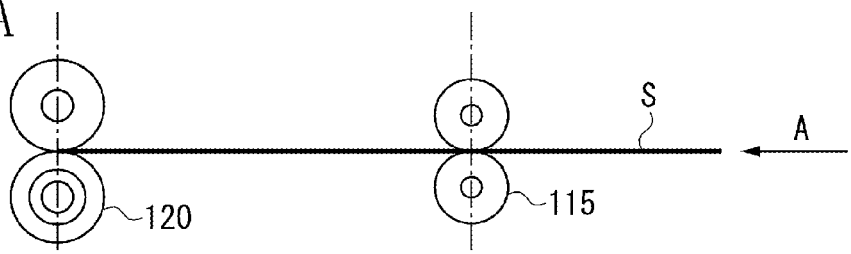
FIGS. 3A, 3B, 3C, and 3D are side views illustrating skew correction and positional deviation correction operations of the registration unit according to the first exemplary embodiment.
Figure 4:
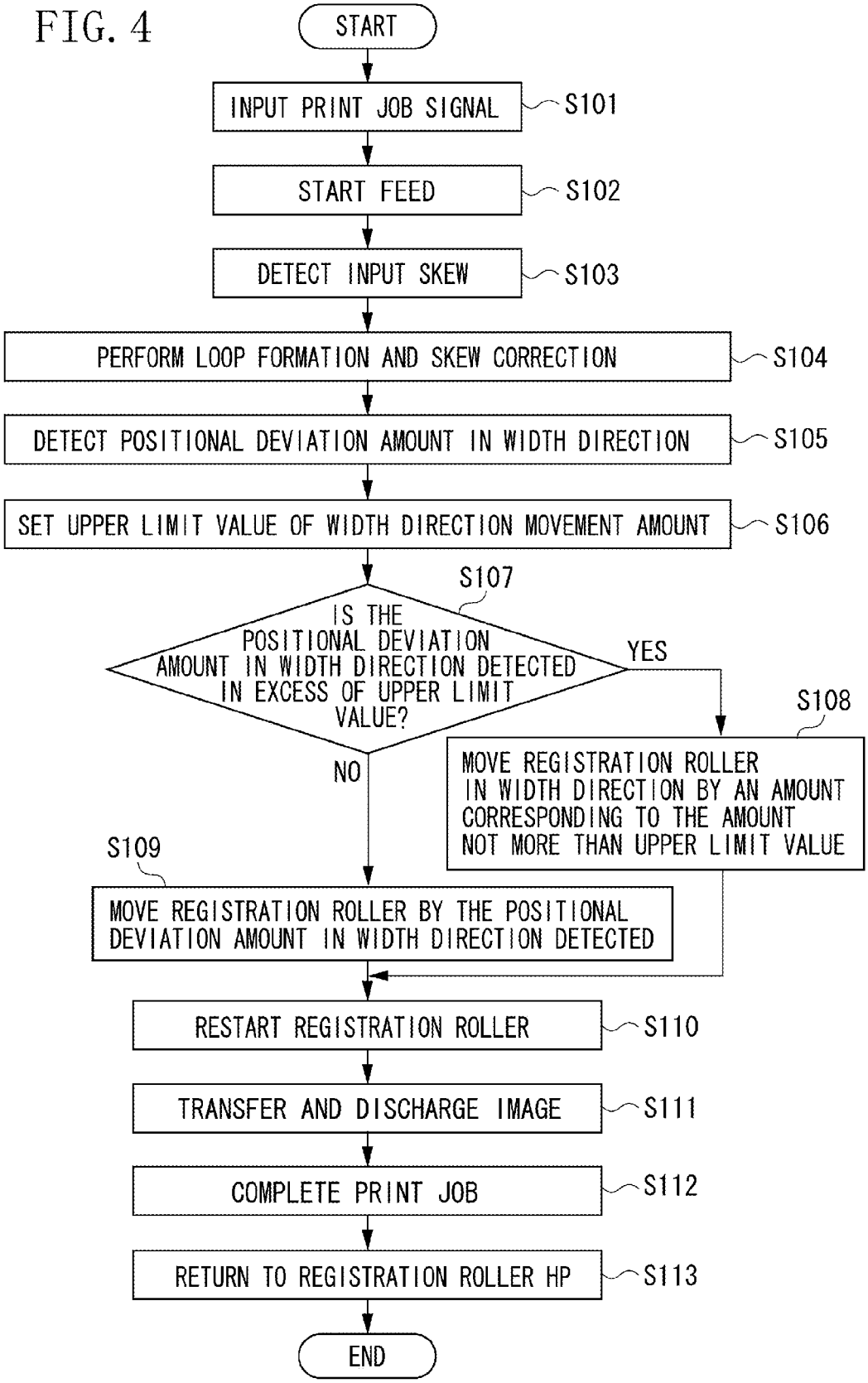
FIG. 4 is a flowchart illustrating a skew correction operation and width-direction positional deviation correction operation of a printer according to the first exemplary embodiment.
Figure 5:
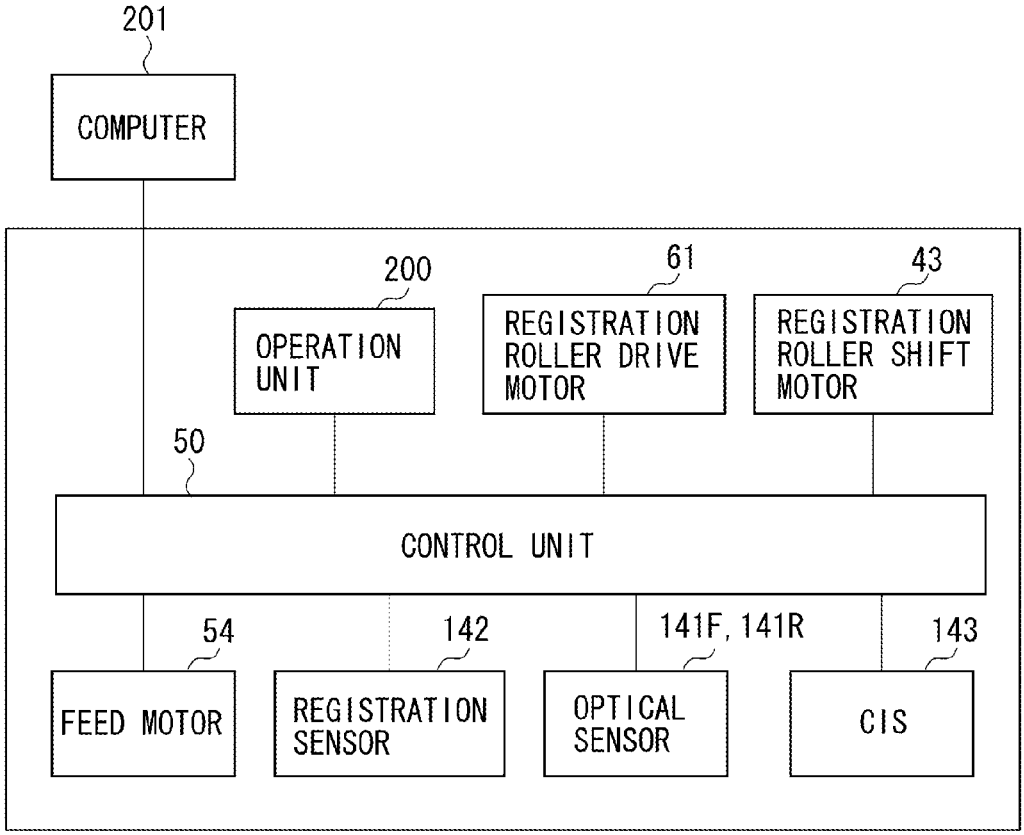
FIG. 5 is a block diagram illustrating the skew correction operation and width-direction positional deviation correction operation of the printer according to the first exemplary embodiment.

FIGS. 2A through 2C are plan views as seen from above in the conveyance path, illustrating the skew correction operation and width-direction position correction operation for the sheet S conveyed to the registration roller 120 by the upstream roller 115, and FIGS. 3A through 3D are side views of the same. FIG. 4 is a flowchart illustrating these operations, and FIG. 5 is a block diagram.

In the operations illustrated below, each unit is controlled by a control unit 50 illustrated in FIG. 5, and the operations are conducted according to the operational flow illustrated in FIG. 4.

Connected to the control unit 50 are the above described optical sensors 141F and 141R, a registration sensor 142, the CIS 143, an operation unit 200, and a computer 201. Further, connected to the control unit 50 are a feeding motor 54, a registration roller drive motor 61, and a registration roller shift motor 43. Based on detection signals from these sensors, the control unit 50 detects the amount and direction of sheet skew and the amount and direction of sheet positional deviation in the width direction. Further, as illustrated below, based on the detection results, the control unit 50 controls the operation of the feeding motor 54, the registration roller drive motor 61, and the registration roller shift motor 43.

Next, referring to FIG. 4, the operational flow of the skew correction operation and width-direction positional deviation correction operation according to the present exemplary embodiment will be illustrated. First, in step S101, a print job signal is input from the operation unit 200 of the image forming apparatus, or from the computer 201 which is connected to the image forming apparatus directly or via a network. In step S102, after the feeding motor 54 is driven, and the sheet feeding operation is started, the sheet is conveyed to the registration unit 116. At this time, in step S103, when the sheet is conveyed in the direction of the arrow A, for example, in the skew feed state in which the sheet is more advanced on the apparatus back side than on the apparatus front side, the skew feed state is detected by the optical sensors 141F and 141R, and the skew amount and the skew orientation are calculated by the control unit 50. Here, the skew orientation means the skew state in which the leading edge portion of the sheet is more advanced on one side in the width direction than on the other side in the width direction. In other words, it means the skew state in which the leading edge portion of the sheet is more advanced on the back side of the apparatus than on the front side of the apparatus, or the skew state in which it is more advanced on the front side of the apparatus than on the back side of the apparatus.

When the conveyance is further continued, the sheet leading edge portion is detected by the registration sensor 142. Further, as illustrated in FIG. 2A and FIG. 3A, the sheet leading edge portion (here, the portion on the apparatus back side thereof) abuts on the runner member on the apparatus back side of the registration upper roller. In this process, the holding torque of the registration roller drive motor 61 (stepping motor) is larger than the abutment force due to the stiffness (rigidity) of the sheet, so that the registration roller 120 remains at rest. As a result, the advancement of the sheet on the registration upper roller is hindered. At this time, since the sheet is in the skew state, the sheet leading edge portion (here, the portion thereof on the apparatus front side) has not abutted on the apparatus front side runner member of the registration upper roller yet.

Figure 3B:
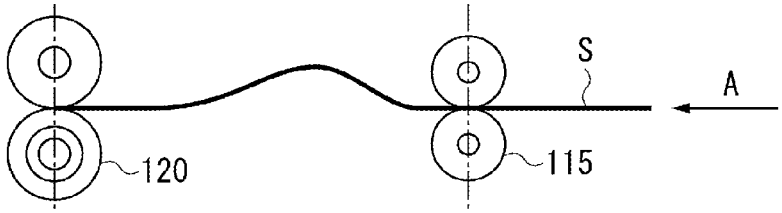

The sheet continues to be conveyed by the upstream roller 115, whereby in step S104, a loop is formed as illustrated in FIGS. 2B and 3B, and the sheet leading edge portion also abuts on the apparatus front side runner member which has not been in contact with the sheet. In other words, the leading edge portion of the sheet being in the skew state at the position of the upstream roller 115 abuts on the nip of the registration roller 120 to be thereby aligned, whereby skew correction is effected. The loop amount of the sheet at this time is adjusted through excessive feeding by a predetermined amount by the upstream roller 115 after the sheet has passed the registration sensor 142 configured to detect the sheet leading edge portion. At this time, twist has been generated in the sheet loop. The twist configuration of the sheet loop in this case will be described in detail below.

Figure 3C:
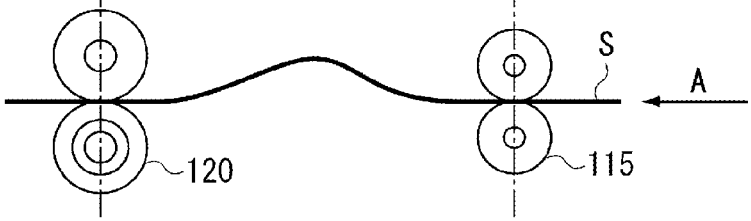

After this, as illustrated in FIGS. 2C and 3C, the rotation of the registration roller 120 is started, and the sheet is conveyed toward the downstream side while maintaining the state in which its skew has been corrected. And, in step S105, the side end portion in the width direction of the sheet is detected by the CIS 143. In other words, the positional deviation amount in the width direction of the sheet is detected. The difference between the detection result and the reference position is the positional deviation amount in the width direction of the sheet to be corrected.

In step S106, in order to correct the positional deviation in the width direction of the sheet, the control unit 50 sets the upper limit value of the movement amount by which the registration roller 120 is to be moved in the width direction to an amount according to the detection result of the registration sensor 142 and the detection result of the CIS 143. Then, in step S107, it is determined whether the positional deviation amount in the width direction of the sheet detected by the CIS 143 is within the range of this upper limit value. As illustrated in FIG. 12, the upper limit value of the movement amount in the width direction of the registration roller 120 for the positional deviation correction is previously set. The upper limit value of the movement amount for positional deviation correction (the positional deviation correction amount) is previously set such that no force in excess of the force with which the registration roller 120 pinches the sheet is applied to the sheet pinched by the registration roller 120.

In step S108, when the positional deviation amount detected by the CIS 143 is in excess of the upper limit value of the previously set positional deviation correction amount (YES in step S107), the registration roller shift motor 43 is driven, and the registration roller 120 is moved in the width direction by an amount corresponding to the amount not more than the upper limit value to thereby correct the positional deviation in the width direction. On the other hand, in step S109, in the case where the positional deviation amount detected by the CIS 143 is within the range of the previously set positional deviation correction amount (i.e., less than the upper limit value) (NO in step S107), the registration roller shift motor 43 is driven, and, using the detected positional deviation amount as the movement amount for positional deviation correction, the registration roller 120 is shifted in the thrust direction. As a result, the positional deviation in the width direction of the sheet is corrected.

Figure 2D:
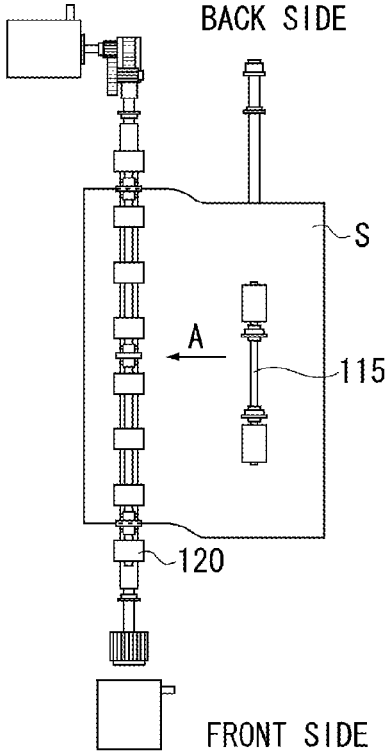
Figure 3D:
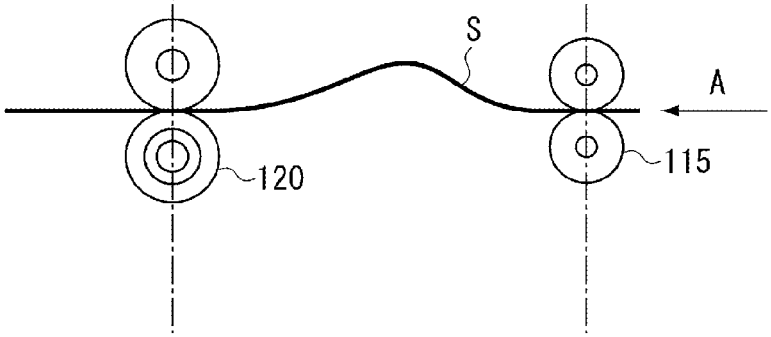

At this time, the registration roller 120 is moved in the thrust direction with respect to the upstream roller 115, which is fixed in position, with the result that twist is generated in the sheet loop as illustrated in FIGS. 2D and 3D. As in the case of the skew correction, the sheet loop twist configuration in this case will be described in detail below.

As illustrated above, in the present exemplary embodiment, in the case where the positional deviation amount detected is in excess of the upper limit value of the movement amount for positional deviation correction in the sheet width direction set in step S106, the sheet is moved in the thrust direction by an amount corresponding to the upper limit value. However, it is also possible to adopt a configuration in which, in the case where the detected positional deviation amount is in excess of the previously set upper limit value of the movement amount, the sheet is not moved in the thrust direction.

After this, in step S110, the registration roller resumes its rotation to convey the sheet to the secondary transfer unit, and, in step S111, the transfer of the image to the sheet and the sheet discharge operation are conducted. After a series of print jobs have been completed in step S112, in step S113, the registration roller 120 is restored to the home position (HP), at which it was placed before the thrust movement.

Figure 6:
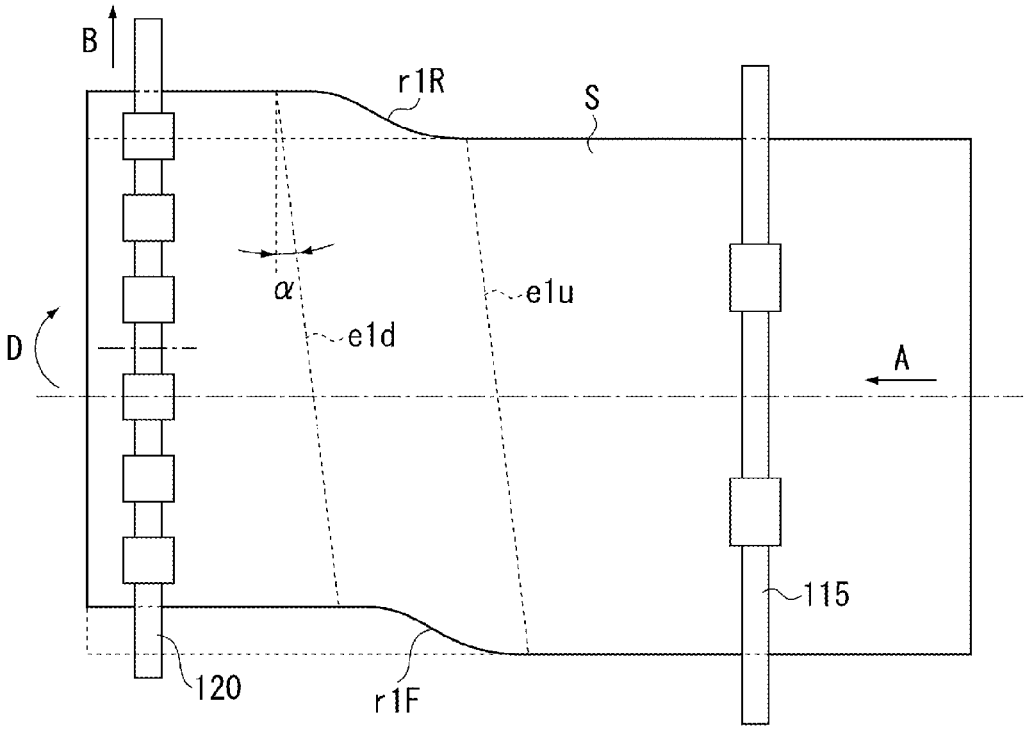
FIG. 6 is a front view illustrating the loop configuration owing to the correction of positional deviation in the width direction at the registration unit.

Next, the loop attributable to the positional deviation correction in the sheet width direction and the skew correction will be illustrated. FIG. 6 illustrates the loop configuration when the registration roller 120 is shifted in the thrust direction in the state in which the sheet is being held between the registration roller 120 and the upstream roller 115.

Here, the movement of the registration roller 120 from the front side to the back side of the apparatus (i.e., the movement in the direction of the arrow B) will be defined as the positive shift, and the movement thereof from the backside to the front side of the apparatus (i.e., the movement in the direction reverse to the arrow B) will be defined as the negative shift.

FIG. 6 illustrates the state in which the registration roller 120 has undergone the positive shift (the movement in the direction of the arrow B). At this time, the sheet loop configuration is as follows: the loop height (size) on the front side r1F and the loop size on the back side r1R are equal to each other, and the ridges e1d and e1u constituting the inflection points in bending are parallel. Further, they are at a certain angle $\alpha$ with respect to the sheet leading edge. It is known that, as a result of this, a turning force in the direction of the arrow D is applied to the portion of the sheet pinched by the registration roller 120.

In reality, it is rare for a loop to be formed in the sheet in such an open space. Usually, it is surrounded by the conveyance guide space, and there is the possibility of the sheet coming into contact with the conveyance guide due to deformation of the loop. In this case, the turning force in the direction of the arrow D acting on the sheet is further enhanced. When this turning force acting on the sheet becomes larger than the pinching force of the registration roller 120, the sheet corrected as described above undergoes positional deviation in the width direction again at the registration roller 120, so that there is a fear of skew. As stated above, generally speaking, the registration roller allows the leading edge timing to effect accurate synchronization with the image. Thus, the pinching pressure of the registration roller is set higher than that of the other conveyance rollers so that no conveyance slip may be generated. Nevertheless, if a force greater than its sheet pinching force acts on the sheet, i.e., if a great turning force is applied to the sheet, slippage of the registration roller 120 may be generated.

Figure 7:
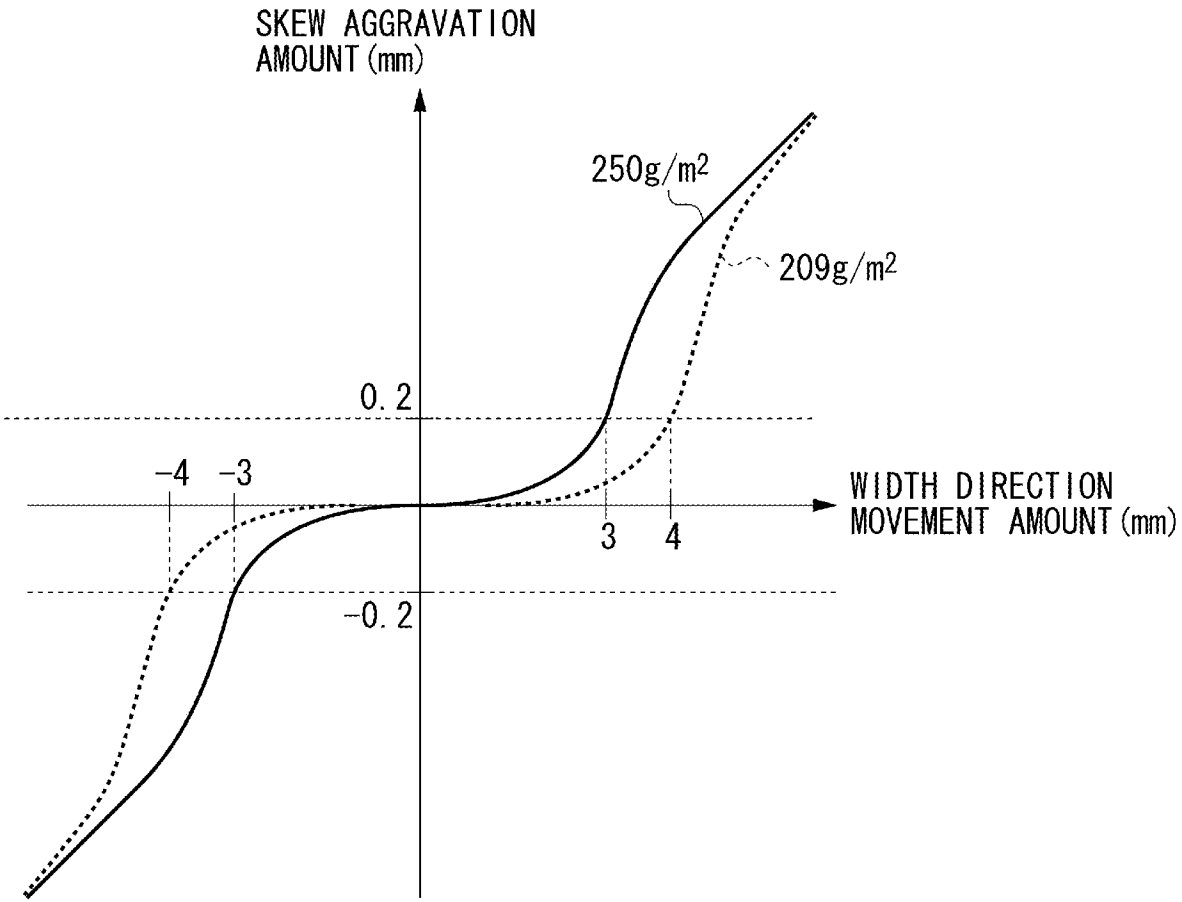
FIG. 7 is a diagram illustrating the relationship between width-direction positional deviation correction amount and skew aggravation amount.

FIG. 7 is a graph indicating the skew aggravation amount with respect to the width-direction positional deviation correction amount for different kinds of sheet, with the pinching force of the registration roller, the loop space, the loop amount, etc. being constant. Here, as the different kinds of sheet, sheets of different basic weights are adopted by way of example: 209 g/m$^2$ and 250 g/m$^2$.

As illustrated in FIG. 7, the larger the movement amount for the positional deviation correction in the sheet width direction, and the higher the stiffness of the sheet, the larger the skew aggravation amount. Here, the skew aggravation amount means the movement amount by which the sheet which has undergone width-direction positional deviation correction and skew feed correction by the turning force acting on the sheet, is allowed to undergo positional deviation in the width direction and skew again at the registration roller 120.

It can be concluded from the above results that, in order to reduce the skew aggravation amount, it is necessary to establish an upper limit to the movement amount for the positional deviation correction in the sheet width direction (the positional deviation correction amount). In the example of FIG. 7, to keep the skew aggravation amount within the range of ±0.2 mm, the upper limit of the positional deviation correction amount is ±4 mm in the case of the sheet of the grammage of 209 g/m$^2$, and the upper limit of the positional deviation correction amount is ±3 mm in the case of the sheet of the grammage of 250 g/m$^2$.

Generally speaking, as the product of image formation, an image inclined with respect to the sheet is mostly of lower quality as compared with an image deviated in position in the width direction of the sheet. However, this is not always the case, so that the upper limit of the movement amount by which the registration roller 120 is moved in the width direction is determined in accordance with the image quality required.

The turning force acting on the sheet as illustrated above can be reduced if it is possible to enlarge the loop space between the registration roller and the upstream roller. In recent years, however, the demand for a reduction in the size of image forming apparatuses has been increasing, and it has become rather difficult to secure a sufficient loop space. Further, there are more and more kinds of sheet nowadays, and there is even a requirement for a sheet of a grammage of 300 g/m$^2$ or more.

Figure 8:
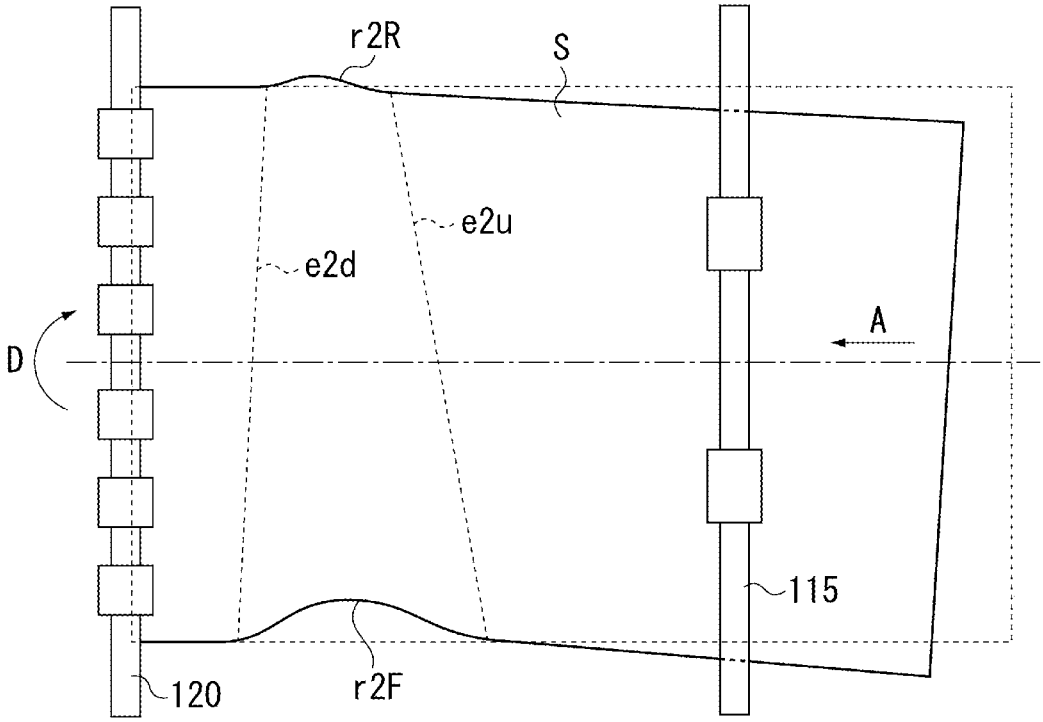
FIG. 8 is a diagram illustrating the configuration of a skew correction loop at the registration unit.

On the other hand, FIG. 8 illustrates the sheet loop configuration when skew correction is effected by the registration roller 120. Here, the skew state in which the sheet leading edge portion is further advanced on the apparatus front side than on the apparatus back side will be defined as the positive input skew (front side advancement), and the skew state in which the sheet leading edge portion is further advanced on the apparatus back side than on the apparatus front side will be defined as the negative input skew feed (back side advancement).

FIG. 8 illustrates the sheet state when positive input skew is corrected. The sheet loop configuration at this time is such that the loop sizes r2F and r2R on the apparatus front side and the apparatus back side are unequal to each other, which means the loop size is larger on the back side than on the front side (r2F>r2R), and that the ridges e2d and e2u constituting the inflection points of bending are not parallel but inclined toward each other. It has been known that, as a result, a turning force in the direction of the arrow D is generated in the portion of the sheet pinched by the registration roller 120. As in the case of the positional deviation correction in the sheet width direction, skew aggravation may also be caused at the registration roller due to the turning force.

Although it is assumed in the above illustration that the two kinds of loops are independent from each other, in reality, the two loop configurations are superposed to form the final loop configuration. Accordingly, the loop pattern can assume four patterns in total according to whether the moving direction at the time of width-direction positional deviation correction is positive or negative and whether the inclining direction at the time of skew correction is positive or negative.

Figure 9:
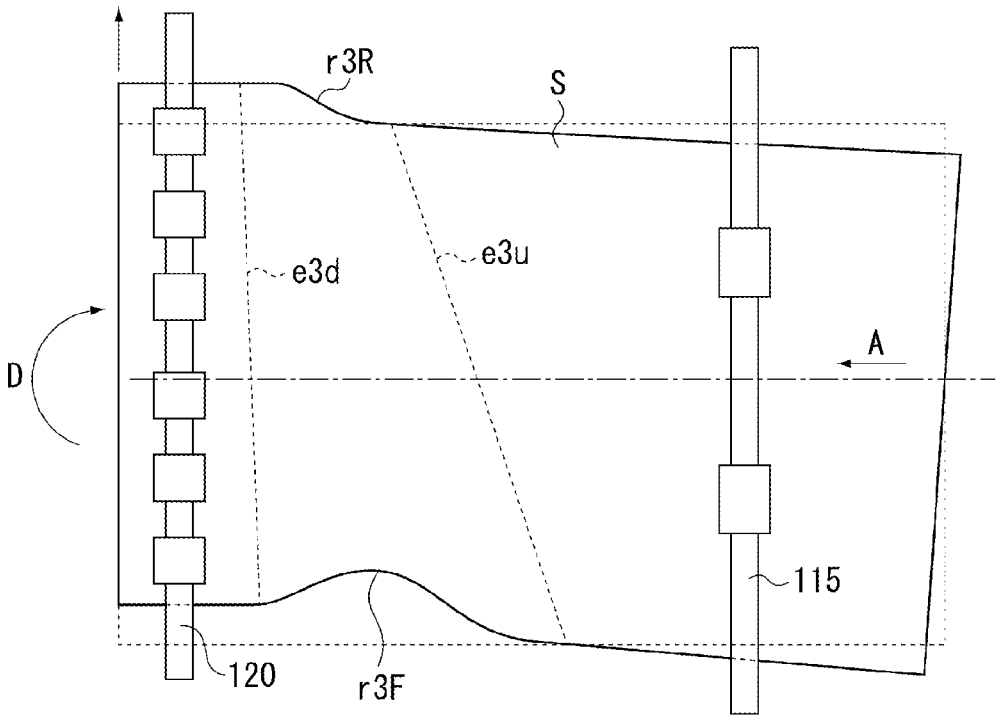
FIG. 9 is a diagram illustrating the loop configuration when the width-direction positional deviation correction and skew correction at the registration unit is positive.
Figure 10:
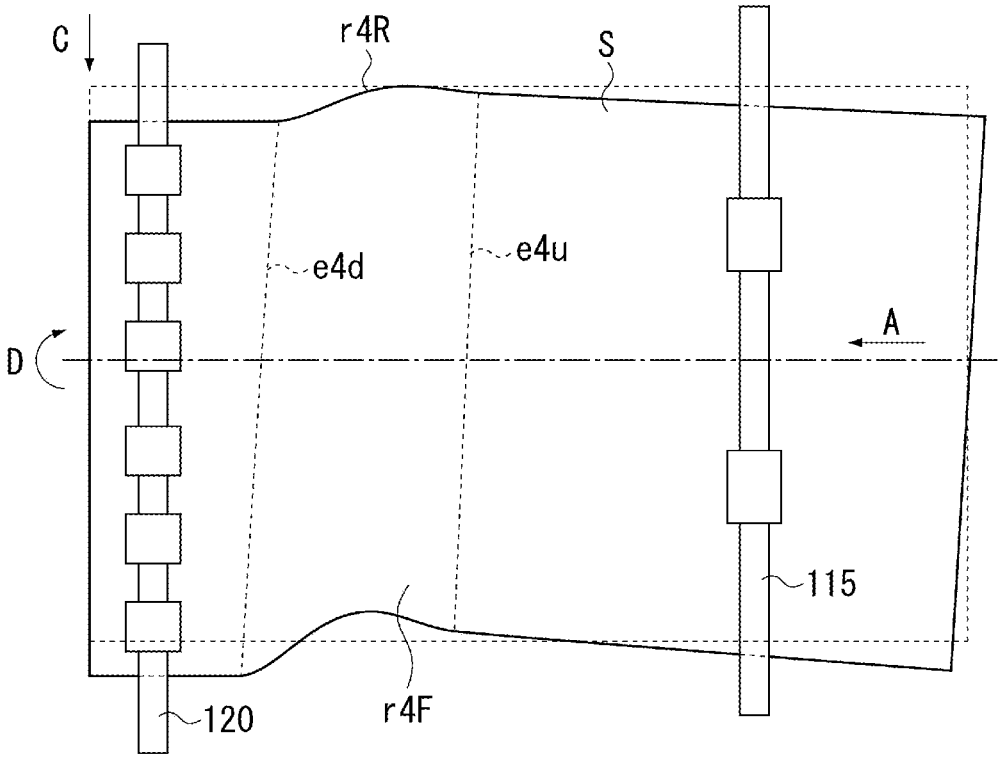
FIG. 10 is a diagram illustrating the loop configuration when the width-direction positional deviation correction at the registration unit is negative and when the skew correction at the same is positive.

Here, FIGS. 9 and 10 illustrate the loop configurations when it is taken into consideration whether the moving direction at the time of positional deviation correction in the sheet width direction, with the inclining direction at the time of skew correction being fixed to either the positive or negative direction. More specifically, FIG. 9 illustrates the loop configuration when a positive input skew-fed sheet is positively shifted, and FIG. 10 illustrates the loop configuration when a positive input skew-fed sheet is negatively shifted. It goes without saying that in the case a negative input skew with a negative inclining direction at the time of skew correction, the sheet loop configuration is symmetrical with those of FIGS. 9 and 10 with respect to the center in the width direction, so that an illustration thereof will be left out.

As illustrated in FIG. 9, in the case where a positive input skew sheet undergoes positional deviation correction in the positive width direction, the size r3F of the loop on the apparatus front side increases, and the size r3R of the loop on the apparatus back side decreases under either influence. Thus, a greater turning force in the direction of the arrow D in the diagram is generated at the registration roller 120. As a result, as compared with the case where the input skew is zero, the upper limit (range) of the permissible positional deviation correction amount in the sheet width direction becomes a smaller amount. More specifically, when it is detected by the registration sensor 142 that the sheet being conveyed is in the skew state in which one side in the width direction of the sheet is more advanced than the other side thereof, the upper limit value of the positional deviation correction amount when moving the registration roller 120 to the other side for the purpose of positional deviation correction in the width direction, is set to a value smaller than the upper limit value in the case where the sheet undergoes no skew feed.

On the other hand, as illustrated in FIG. 10, in the case where a positive input skew sheet undergoes positional deviation correction in the negative width direction, the sizes r4F and r4R of the loops on the apparatus front side and the apparatus back side are made equal to each other, and the turning forces applied to the registration roller 120 cancel out each other. As a result, as compared with the case where the input skew is zero, the upper limit (range) of the permissible positional deviation correction amount in the sheet width direction becomes a larger value. In other words, when it is detected by the registration sensor 142 that the sheet being conveyed is in the skew state in which one side in the width direction of the sheet is more advanced than the other side thereof, the upper limit value of the positional deviation correction amount when moving the registration roller 120 to one side for positional deviation correction in the width direction is set to a value larger than the upper limit value in the case of a sheet undergoing no skew.

The above illustration completely applies to the case where positive and negative are reversed. More specifically, as compared with the case where the input skew is zero, in the case where the skew and the positional deviation are both either positive or negative, the range of the permissible positional deviation correction amount in the width direction of the sheet is small, whereas in the case where one of the skew and the positional deviation is positive or negative, with the other being reverse thereto, the range of the permissible positional deviation correction amount in the sheet width direction is large.

Figure 11:
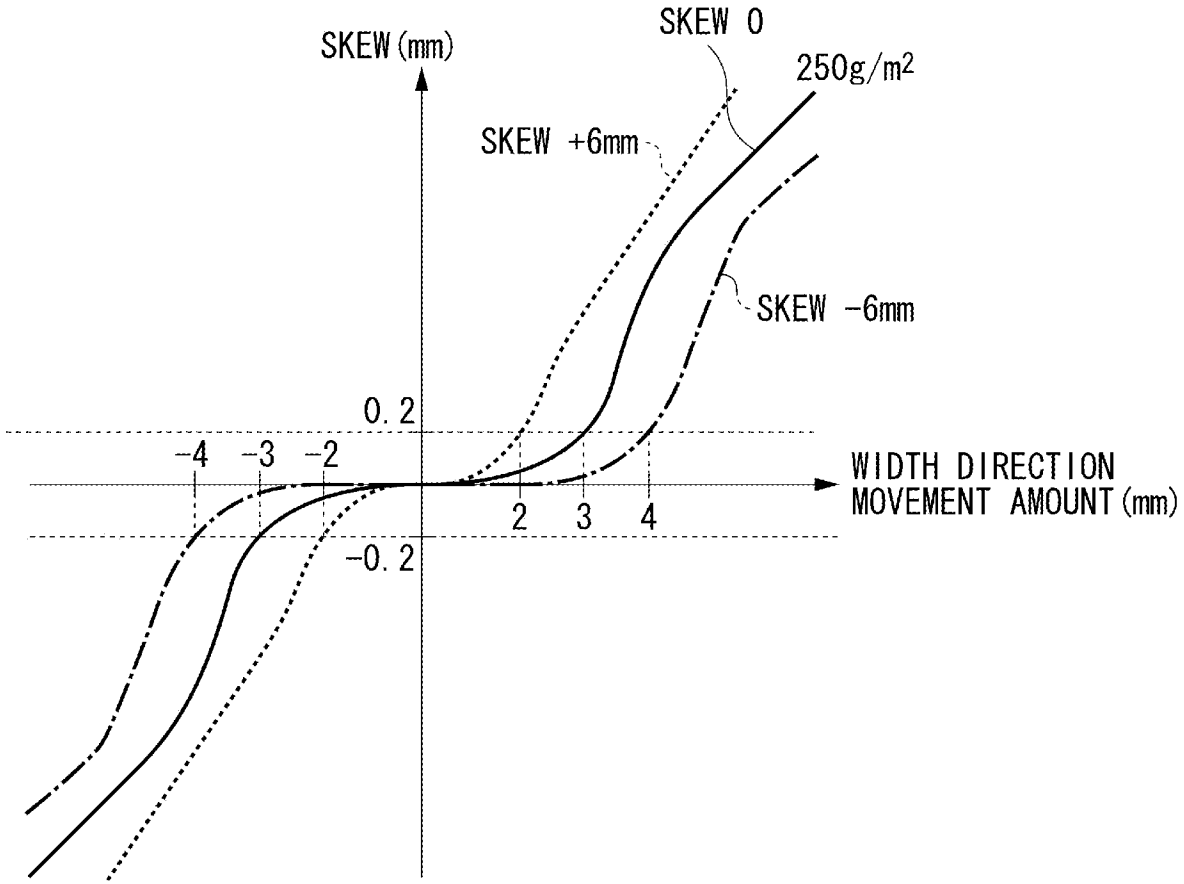
FIG. 11 is a diagram illustrating the relationship between width-direction positional deviation correction amount and skew aggravation amount when input skew feed is taken into account.

FIG. 11 is a graph illustrating the above phenomenon. Here, a case is assumed where the input skew of a sheet of a grammage of 250 g/m$^2$ is ±6 mm, and the permissible amount for suppressing the skew aggravation amount due to the positional deviation correction in the width direction to the range of ±0.2 mm is indicated. First, in the case where the input skew is zero, the permissible amount for suppressing the skew feed aggravation amount due to the positional deviation correction in the width direction to the range of ±0.2 mm is ±3 mm. In contrast, in the case where the input skew feed is +6 mm, the permissible amount ranges from −4 mm. to +2 mm, and, in the case where the input skew feed is −6 mm, the permissible amount ranges from −2 mm to +4 mm.

Further, various input skew values are assumed, with the result that a matrix table as illustrated in FIG. 12 is obtained. Here, the possibility of positional deviation correction in the width direction when the permissible skew aggravation amount is within the range of ±2 mm is indicated by symbols ○ and x. In this way, the input skew prior to the positional deviation correction in the width direction is previously detected and superposed with the positional deviation correction amount in the width direction to thereby determine the upper limit value of the width-direction positional deviation correction amount, whereby it is possible to prevent aggravation of the skew from occurring. Conversely, when the skew is not easily aggravated, a large positional deviation correction amount in the width direction is secured, whereby it is possible to achieve a further improvement in terms of image printing accuracy.

In the present exemplary embodiment, the calculation of the upper limit value of the positional deviation correction amount in the width direction is performed in step S106 of FIG. 4 with reference to the table shown in FIG. 12. For example, when the input skew amount is 1 mm, it is determined, based on the table of FIG. 12, that the upper limit value of the positional deviation correction amount in the width direction is 3 mm on both the positive and negative sides. In this case, if the input (detected) positional deviation correction amount in the width direction is +2 mm, it is within the range of the upper limit value (±3 mm) of the positional deviation correction amount in the width direction, so that positional deviation correction in the width direction is conducted (i.e., the registration roller 120 is moved in the width direction) by +2 mm. More specifically, a correction amount corresponding to the detection results of the optical sensors 141F and 141R is obtained from the correction amounts previously set as illustrated in FIG. 12, and the correction amount detected by the CIS 143 is restricted to the range of the above described correction amount obtained. Here, the range of the previously set correction amount is a range in which no force in excess of the force with which the registration roller pinches the sheet is applied to the sheet pinched by the registration roller.

On the other hand, when the input positional deviation correction amount in the width direction is +5 mm, it is in excess of the upper limit value (±3 mm) of the positional deviation correction amount in the width direction, so that positional deviation correction in the width direction is effected by an amount corresponding to +3 mm, which is the upper limit value. In other words, when the positional deviation amount in the width direction detected by the CIS 143 exceeds the range of the upper limit value, the registration roller 120 is moved in the width direction by an amount corresponding to the upper limit value, thereby correcting the positional deviation in the width direction of the sheet.

Although in the example illustrated above a specific value is adopted as the upper limit value of the positional deviation correction amount in the width direction according to the input skew amount and the input width-direction positional deviation amount, this should not be construed restrictively. In the present invention, a specific value is to be determined according to the characteristics of the apparatus.

As illustrated above, in the present exemplary embodiment, when the positional deviation amount in the width direction detected by the CIS 143 exceeds the previously determined upper limit value, the movement amount by which the registration roller 120 is moved in the width direction is restricted.

Specifically, in the case where the positional deviation in the width direction of a sheet in a skew state in which one side is more advanced than the other side in the width direction thereof, the upper limit value of the movement amount for the positional deviation correction is set as follows. The upper limit value of the movement amount by which the registration roller 120 is moved to the other side is set to a value smaller than the upper limit value of the movement amount by which the registration roller 120 is moved to one side. More specifically, as compared with the case in which positional deviation correction in the width direction is performed on a sheet which has not been in a skew state, the upper limit value of the movement amount by which the registration roller 120 is moved to the other side is set to a smaller value, and the upper limit value of the movement amount by which the registration roller 120 is moved to one side is set to a larger value.

Thus, according to the present exemplary embodiment, it is possible to secure a maximum positional deviation correction amount in the width direction of the sheet while minimizing the aggravation of skew at the time of correction of positional deviation attributable to the loop twist reaction force of the sheet, and to achieve, at the same time, a reduction in apparatus size and cost.

Figure 13A:
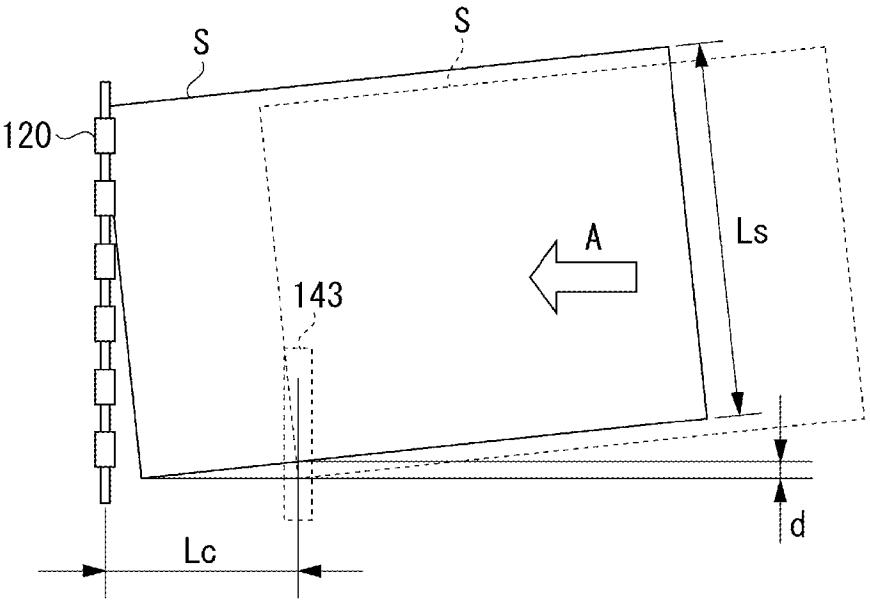
FIGS. 13A and 13B are a side view and a front view illustrating input skew detection at a registration unit according to a second exemplary embodiment.
Figure 13B:
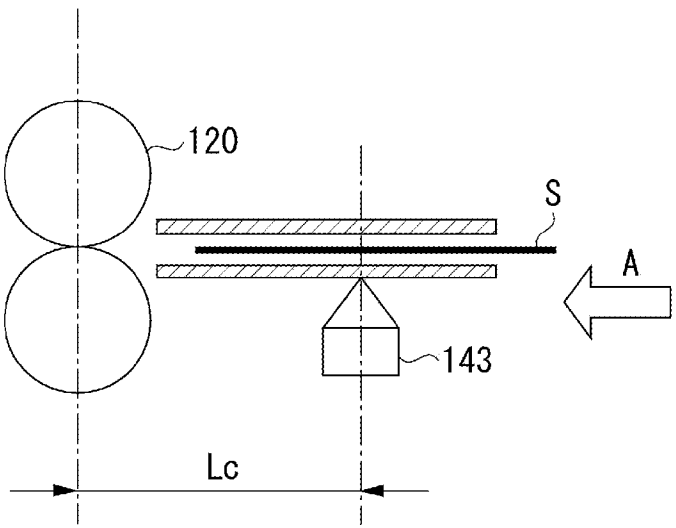

Next, an image forming apparatus to which a sheet skew feed correction apparatus according to the second exemplary embodiment is applied will be illustrated with reference to FIGS. 13A and 13B. Regarding the basic configuration for skew correction and width-direction positional deviation correction, the effect attained through superposing of the loop attributable to the skew correction operation and the loop attributable to the width-direction positional deviation correction operation, etc., the present exemplary embodiment is the same as the first exemplary embodiment illustrated above, so a redundant illustration will be left out. The present exemplary embodiment differs from the first exemplary embodiment illustrated above in the skew detection unit for detecting skew of the sheet.

In the first exemplary embodiment, the CIS 143 as the position detection unit for detecting positional deviation in the width direction of the sheet is arranged on the downstream side of the registration roller 120 in the sheet conveyance direction, whereas, in the present exemplary embodiment, it is arranged on the upstream side of the registration roller 120 in the sheet conveyance direction.

And, in the present exemplary embodiment, the CIS 143 as the position detection unit detects an end portion in the width direction of the sheet a plurality of times until the sheet abuts on the registration roller 120 after the leading edge portion of the sheet passes the CIS 143. Here, the position of the sheet in the width direction is detected when the sheet leading edge reaches the CIS 143 and when it abuts on the registration roller 120.

Then, the control unit calculates the skew of the sheet from the transition of the sheet leading edge positions detected a plurality of times by the CIS 143. Here, as illustrated in FIGS. 13A and 13B, the distance between the registration roller 120 and the CIS 143 is Lc. The difference between the position in the width direction detected when the sheet leading edge reaches the CIS 143 and the position detected when the sheet leading edge abuts on the registration roller 120 is expressed as d. To convert it into the input skew feed amount at the sheet leading edge for the purpose of comparison with the first exemplary embodiment, the skew feed amount s of the sheet is calculated as follows, taking into consideration the length Ls of the sheet in the width direction: $s=Ls/Lc\times d$.

According to the present exemplary embodiment, in addition to the effect of the first exemplary embodiment, the position detection unit also serves as the skew detection unit, so that it is possible to achieve a further reduction in apparatus size and cost.

Still another exemplary embodiment of the present invention will be illustrated. Although in the exemplary embodiments illustrated above four image forming units are used, the number of image forming units used is not restricted to four but may be differently set as appropriate.

Further, although in the exemplary embodiments illustrated above the image forming apparatus consists of a printer, this should not be construed restrictively. For example, it may also be some other image forming apparatus such as a copying machine or a facsimile apparatus or a multifunction peripheral in which their functions are combined. It is possible to attain the same effect by applying the present invention to a sheet conveyance apparatus (a sheet skew correction apparatus) for such image forming apparatuses.

Further, although in the exemplary embodiments illustrated above the sheet conveyance apparatus is provided integrally with the image forming apparatus, this should not be construed restrictively. For example, the sheet conveyance apparatus may be detachable with respect to an image forming apparatus. It is possible to attain the same effect by applying the present invention to such a sheet conveyance apparatus.

Further, although in the exemplary embodiments illustrated above the sheet conveyance apparatus conveys a sheet such as a recording paper as a recording target while pinching the same, this should not be construed restrictively. It is possible to attain the same effect by applying the present invention to a sheet conveyance apparatus configured to convey a sheet such as a document as a reading target while pinching the same.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-148216 filed Jul. 4, 2011, which is hereby incorporated by reference herein in its entirety.

What is claimed is:

1. A sheet conveyance apparatus comprising:

a first conveyance unit configured to convey a sheet;

a second conveyance unit configured to convey the sheet conveyed by the first conveying unit while pinching the same;

a position detection unit configured to detect a position of an end portion of the sheet being conveyed in a width direction which is orthogonal to the sheet conveyance direction;

a correction unit configured to move the second conveyance unit pinching the sheet in the width direction to correct positional deviation in the width direction of the sheet;

a control unit configured to control the operation of the correction unit so as to correct the positional deviation based on the detection result of the position detection unit; and a skew detection unit configured to detect skew of the sheet before the sheet leading edge portion abuts on the second conveyance unit, wherein the control unit is configured, when a deviation amount of the position of the end portion of the sheet detected by the position detection unit from a reference position is equal to or smaller than a predetermined amount, to move the second conveyance unit in the width direction by the deviation amount, wherein the control unit is configured, when the deviation amount of the position of the end portion of the sheet detected by the position detection unit from the reference position exceeds the predetermined amount, to move the second conveyance unit in the width direction by an amount equal to or smaller than the predetermined amount, wherein the first conveyance unit is configured to correct the skew of the sheet by causing the sheet leading edge portion to abut on the second conveyance unit, and wherein the control unit is configured to set the predetermined amount based on the detection result of the skew detection unit.

2. The sheet conveyance apparatus according to claim 1, wherein the control unit is configured, in a case where it is detected by the skew detection unit that the sheet being conveyed has been in a skew state in which the sheet is further advanced on one side than on the other side in the width direction thereof, to set the predetermined amount to a first predetermined amount when the second conveyance unit is moved to one side in the width direction by the correction unit, wherein the control unit is configured, in a case where it is detected by the skew detection unit that the sheet being conveyed is undergoing no skew, to set the predetermined amount to a second predetermined amount when the second conveyance unit is moved to one side in the width direction by the correction unit, and wherein the first predetermined amount is larger than the second predetermined amount.

3. The sheet conveyance apparatus according to claim 1, wherein the control unit is configured, in a case where it is detected by the skew detection unit that the sheet being conveyed has been in a skew state in which the sheet is further advanced on one side than on the other side in the width direction thereof, to set the predetermined amount to a first predetermined amount when the second conveyance unit is moved to the other side in the width direction by the correction unit, wherein the control unit is configured, in a case where it is detected by the skew detection unit that the sheet being conveyed is undergoing no skew, to set the predetermined amount to a second predetermined amount when the second conveyance unit is moved to the other side in the width direction by the correction unit, and wherein the first predetermined amount is smaller than the second predetermined amount.

4. The sheet conveyance apparatus according to claim 1, wherein the control unit is configured, in a case where it is detected by the skew detection unit that the sheet being conveyed has been in a skew feed state in which the sheet is further advanced on one side than on the other side in the width direction thereof, to set the predetermined amount to a first predetermined amount when the second conveyance unit is moved to one side in the width direction by the correction unit, wherein the control unit is configured, in the case where it is detected by the skew detection unit that the sheet being conveyed has been in a skew state in which the sheet is further advanced on one side than on the other side in the width direction thereof, to set the predetermined amount to a second predetermined amount when the second conveyance unit is moved to the other side in the width direction by the correction unit, and wherein the first predetermined amount is larger than the second predetermined amount.

5. The sheet conveyance apparatus according to claim 1, wherein the control unit is configured, when the deviation amount of the position of the end portion of the sheet detected by the position detection unit from the reference position exceeds the predetermined amount, to move the second conveyance unit in the width direction by the predetermined amount.

6. The sheet conveyance apparatus according to claim 1, wherein the control unit is configured, when the amount by which the correction unit moves the second conveyance unit in the width direction exceeds the predetermined amount, not to move the second conveyance unit in the width direction.

7. The sheet conveyance apparatus according to claim 1, wherein the position detection unit is configured to function as the skew detection unit and is configured to be arranged on the upstream side of the second conveyance unit in the conveyance direction, and detect an end portion in the width direction of the sheet a plurality of times until the leading edge portion of the sheet abuts on the second conveyance unit after passing the position detection unit, and wherein the control unit is configured to calculate the amount and direction of sheet skew from a transition of the position of the end portion of the sheet detected by the position detection unit a plurality of times.

8. An image forming apparatus comprising an image forming unit configured to form an image on a sheet and the sheet conveyance apparatus according to claim 1.

9. The sheet conveyance apparatus according to claim 1, wherein the control unit is configured to calculate the deviation amount of the position of the end portion of the sheet detected by the position detection unit from the reference position.

10. The sheet conveyance apparatus according to claim 1, wherein the first conveyance unit is configured to correct the skew of the sheet by causing the sheet leading edge portion to abut on the second conveyance unit and forming a loop of the sheet.

11. The sheet conveyance apparatus according to claim 1, wherein the first conveyance unit includes a pair of rollers configured to nip and convey the sheet, and wherein the second conveyance unit includes a pair of rollers configured to nip and convey the sheet.

12. The sheet conveyance apparatus according to claim 1, wherein the control unit is configured, in a case where it is detected by the skew detection unit that the sheet being conveyed has been in a skew feed state in which the sheet is further advanced on one side than on the other side by a first amount in the width direction thereof, to set the predetermined amount to a first predetermined amount when the second conveyance unit is moved to one side in the width direction by the correction unit, wherein the control unit is configured, in the case where it is detected by the skew detection unit that the sheet being conveyed has been in a skew state in which the sheet is further advanced on one side than on the other side by a second amount which is larger than the first amount in the width direction thereof, to set the predetermined amount to a second predetermined amount when the second conveyance unit is moved to one side in the width direction by the correction unit, and wherein the first predetermined amount is larger than the second predetermined amount.

13. The sheet conveyance apparatus according to claim 1, wherein the control unit is configured to set the predetermined amount based on the detection result of the skew detection unit and the detection result of the position detection unit.

* * * * *